US006237599B1

(12) United States Patent
Maulding

(10) Patent No.: US 6,237,599 B1
(45) Date of Patent: May 29, 2001

(54) BREASTFEEDING BREAST SUPPORT ROLL AND METHOD

(76) Inventor: Pamela Saul Maulding, 606 Ivanhoe Ct., Chesapeake, VA (US) 22332

( * ) Notice: Subject to any disclaimer, the term of this patent is extended or adjusted under 35 U.S.C. 154(b) by 0 days.

(21) Appl. No.: 09/460,181

(22) Filed: Dec. 11, 1999

(51) Int. Cl.[7] ..... A61G 15/00
(52) U.S. Cl. ..... 128/845; 128/890; 5/652
(58) Field of Search ..... 128/845, 846, 128/890; 5/630, 652, 655

(56) References Cited

U.S. PATENT DOCUMENTS 5,109,557 * 5/1992 Koy ..... 5/655
5,519,906 * 5/1996 Fanto-Chan ..... 5/631
5,707,031 * 1/1998 Craighton-Young ..... 248/118

* cited by examiner

*Primary Examiner*—Michael A. Brown
(74) *Attorney, Agent, or Firm*—David J. Bolduc

(57) ABSTRACT

A breastfeeding breast support roll is constructed of an outer layer of soft, absorbent material filled with compressible and or resilient material. The breastfeeding breast support roll is placed underneath the breastfeeding breast, allowing a woman to breastfeed an infant in an upright position without difficulty. The breastfeeding support roll lifts the breast upright and directs the nipple outward to enable proper positioning of the baby to latch onto the nipple for proper breastfeeding. The breastfeeding breast support roll promotes successful breastfeeding efforts by providing a breastfeeding aid that is portable, compact, convenient and simple to use and position.

10 Claims, 3 Drawing Sheets

FIG. 1
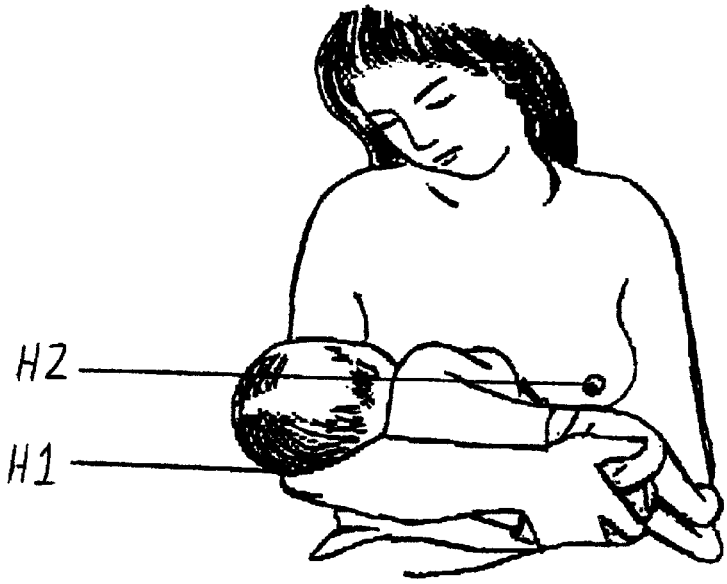
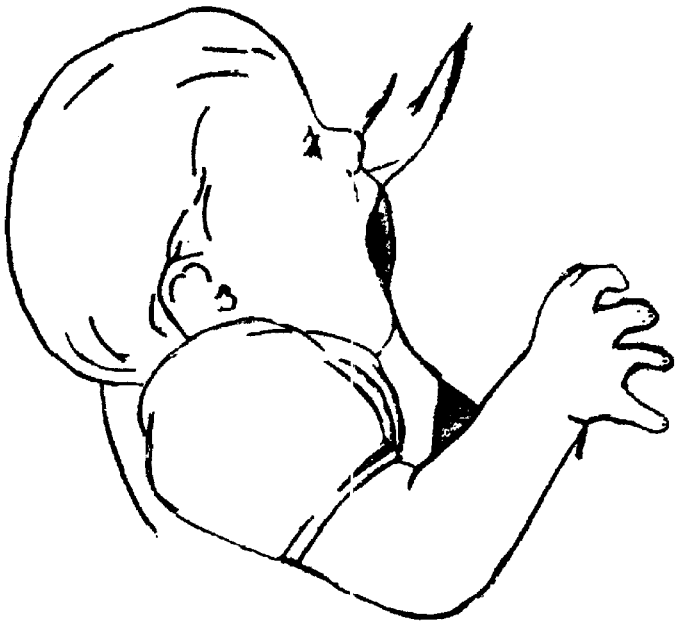
FIG. 2

BREASTFEEDING BREAST SUPPORT ROLL AND METHOD

BACKGROUND OF THE INVENTION

1. Field of Invention

This invention relates generally to the art of breastfeeding. Specifically, the invention relates to a breastfeeding breast support roll and method wherein the breastfeeding breast support roll may be placed beneath a breast to uplift the breast and nipple and place them in proper relation to the infant's mouth in order to facilitate the act of breastfeeding.

2. Description of Prior Art

Much has been written extolling the benefits of breastmilk for mothers and their newborns. Recently the American Academy of Pediatrics (AAP), in a policy statement on breastfeeding, came out with a very strong stance on the importance of human milk, especially in the first year of a baby's life. These new guidelines recommend that "breastfeeding continue for at least 12 months, and thereafter for as long as mutually desired." This statement encourages Pediatricians and other Health Care Providers who work with nursing moms to promote breastfeeding as a normal part of daily life, and encourage family and societal support for breastfeeding. Human milk is the preferred feeding for all infants, including premature and sick newborns, with rare exceptions. Human milk is uniquely superior for infant feeding; breast milk is easily digested and all substitute feeding options differ markedly from it.

Research has shown that "human milk and breastfeeding of infants provide advantages with regard to general health, growth, and development, while significantly decreasing risk for a large number of acute and chronic diseases." Breastfed babies are less likely to get diarrhea, ear infections, respiratory infections, bacteremia, bacterial meningitis, botulism, necrotizing enterocolitis (NEC), and urinary tract infections than their formula fed peers. Studies also show that nursing may also be protective against SIDS, diabetes, Crohn's disease, ulcerative colitis, lymphoma, allergies and other chronic digestive diseases. Breastmilk may also provide protection from Multiple Sclerosis and reduce cancer risks in children and women. Studies have also shown breastfed infants have better intellectual development, having higher IQs than bottle fed infants and that breastfed babies grow up to be leaner than bottle fed babies. Also, breastfeeding gives the baby a sense of closeness, warmth, and security.

Breastfeeding is also beneficial to the mother. Nursing mothers have been found to return to their normal weight more rapidly. They also experience a delay in the resumption of ovulation, and increased child spacing. Furthermore, mothers who nurse their babies reduce their risk of developing ovarian and premenopausal breast cancer. They also have improved bone remineralization with a reduction in hip fractures and osteoporosis in the postmenopausal period. Also, breastmilk is low in cost, convenient and readily available and can save $1,000 a year in feeding costs Referring to FIGS. 1 and 2: In order to breastfeed properly, it is crucial to have the breastfeeding baby properly positioned in relation to the breast. Proper positioning ensures that the infant achieves a proper "latch-on" with the breast. Positioning and posture of the body, and the position of the baby's body in relationship to the mother's, is of utmost importance. For example, when using a cradle hold as in FIG. 1, the baby's head should rest in the crook of the mother's elbow, with the forearm supporting his back, and the hand holding the buttocks or upper thigh. The baby is lying on his side with his whole body facing the mother and his head is in a straight line with his body. In this position, with the baby's head in the crook of the mother's arm, the baby's mouth is positioned parallel with the mother's nipple. This parallel positioning allows the baby to properly latch-on to the mother's nipple, as in FIG. 2.

Other positions include the side-lying position which is good if uncomfortable sitting up, such as after a cesarean, or if nursing at night. Other holds include the clutch hold (also referred to as the "football" hold) which is a good position to use particularly if the breasts are large, or when nursing a small or premature baby. Typically, a pillow is used underneath the baby to bring him or her up to the level of the breast.

Typically, with all these holds/positions, it is necessary for the mother's free hand to be used to position the breast. The breast is supported with the fingers underneath and the thumb on top, behind the areola. The baby opens his mouth wide and the nipple is centered in his mouth and the baby pulled in very close to the body. Once the baby is latched on correctly and actively nursing, most mothers may let go of the breast, unless it is too heavy for the baby to control.

Once the baby is nursing, it is necessary to check that he is latched-on at the breast properly as in FIG. 2. First, the baby's lips need to be flanged out ("fish-lips"). Both upper and lower lips should be flanged out and if the lips are tucked should be pulled out. Secondly, the baby's tongue should be cupped around the breast below the lower lip. When these things are confirmed and nursing is comfortable, the baby is probably positioned and latched on correctly. The baby should have not only the nipple but also as much areola as possible in his mouth, otherwise nursing may be painful. If there is more than the slightest discomfort, or the baby did not get latched onto an inch or so of areola, the latch should be broken by inserting a finger into the corner of the baby's mouth or pulling down gently on his chin to break the suction and try the entire process again.

Referring now to FIG. 6: Large breasted women invariably have a difficult time establishing proper position, and therefore a proper latch, due to the size and shape of the large breast. A large breast has a tendency to sag below the level that the arm can comfortably cradle the baby within the lap space available. The baby's head in the crook of the mother's arm is then improperly positioned above the breast and nipple. Also with a large breast, the nipple is positioned pointing downwardly rather than outwardly, which is necessary for proper latching. The problem can be further exacerbated if the infant is small or born prematurely.

Sometimes a small baby, born to a large breasted mom, will need a few weeks to "grow into" nursing. The first six weeks of the baby's life is a time of adjustment and during this time that the mother and baby begin fine-tuning the nursing relationship. And if the baby isn't nursing well in the early days, it may be necessary to express milk when a feed is missed. Manual expression of milk may be difficult and may detract from establishing the nursing relationship.

Studies have also shown that overweight and obese women have significantly less success breastfeeding their babies than their normal-weight counterparts. And the heavier the mother, the researchers found, the less successful she was at initiating and maintaining breastfeeding. Obese women generally have large, flat breasts with large areolas and flat or inverted nipples that make latching on more challenging for the infant and the mother.

Some large breasted mothers have difficulty lifting their babies up to their breasts because their breasts almost touch their laps as they sit down. Lactation consultants suggest that these women place a rolled diaper or folded receiving blanket under the breast for support, lifting it high enough for the baby to latch on to the nipple. Another suggestion for supporting the breast is using a soft, stretchy piece of fabric, worn around the neck, and brought under one breast, gently supporting it. Supporting and lifting the breast also helps to keep the breast from covering the baby's nose, enabling baby to breathe and swallow properly. Whatever method is chosen to support the breasts, it is important they are well supported without distorting their shape.

Also, it can sometimes be challenging for the large breasted woman to find a comfortable position in which to nurse. For the nursing mother with large breasts, there are several positions that are often recommended. For example, some suggest feeding the baby while sitting back in a recliner, with the baby at the mother's side, on her back, supported to breast level. Leaning back in the recliner allows the breast tissue to flatten slightly, making it easier for the baby to access the nipple/areola.

Another suggestion is that large breasted women hold their breast with fingers underneath and thumb on top throughout the nursing session. This maneuver, in addition to keeping their breasts off the baby's chin and nose, also keeps their nipple in the baby's mouth. Otherwise, the weight of the heavy breast applies pressure on the baby's mouth, making it difficult for the baby to keep the nipple in his mouth. Also, the mother's nipple can be hurt when it falls out of the baby's mouth. Furthermore, the mother with large breasts should (be cautioned) not to lean over her baby while nursing; the baby can slip off the milk reservoirs and will only be compressing his jaws around milk tubing near the nipple. He will not get as much milk, and he may damage the mother's nipples.

Some large breasted women also have large areolas and nipples. To release the milk in his mother's breast, the baby needs to compress the lactiferous sinuses (also called milk sinuses or milk reservoirs) located under the areola. Therefore it is important for the baby to grasp all of the nipple and as much of the areola as his mouth allows. Lactation consultants encourage mothers with large areolas and nipples to wait until the baby opens his mouth wide as if he were yawning. This enables the baby to take all of her nipple and as much of her areola as his mouth can hold. Although the tiny baby may have difficulty latching on to the large nipple and areola, with careful positioning and patience most babies can suck efficiently.

Although large breasted women often have more difficulty positioning their babies at the breast while sitting up, nursing lying down is sometimes easier for them. In the traditional lying-down position, the mother lies on her side with a pillow under her head. She positions the baby on his side with his mouth in line with her nipple. Her breast may rest on the mattress with her nipple low enough for the baby to grasp easily. Once the baby has latched on properly, placing pillows behind his back will help support him while nursing.

When the baby is old enough to hold up his head, the large breasted mother can lie on her back and hold her baby face down on top of her to nurse. This position enables the baby to grasp the nipple easily and keep it in his mouth. Also, in this position gravity lets the breast tissue fall away from the baby's nose, making it easier for him to breathe. The mother can position her baby parallel to her, with his legs falling between her legs, or she can position him lying across her with his feet falling to her side. In this position, the mother needs to make sure her baby's neck is not hyperextended.

The sit position is another position that can be used with a baby old enough to hold his head up. The baby's buttocks sit on the mother's thigh, while his legs straddle her thigh. The baby faces his mother's breast nursing in an upright position. Another position especially helpful for some large breasted mothers is the football hold. The mother positions her baby with his legs under her arm and his head resting in her hand. She may or may not need pillows to bring him up to her breast. With the football hold, the large breasted mother will need to hold her breast throughout nursing to keep the weight off the baby's chin. The football hold provides good visibility of the baby's sucking and enables some large breasted mothers to nurse more comfortably.

Many items of the prior art have been provided to promote and facilitate breastfeeding. For example. nursing pillows are available today to provide support for babies and the arms of the nursing mother. These pillows offer support for a child or infant or provide back support for the user of the pillow, or provide an inwardly-angled surface area which allows babies to roll towards the user.

For example, two pillows designed for support while nursing are described in U.S. Pat. No. 5,109,557 to Koy and U.S. Pat. No. 4,731,890 to Roberts. These pillows are generally L-shaped, forming a support surface for an infant and a user's arm. U.S. Pat. No. 5,519,906 to Fanto-Chan is a fastening support pillow that has a crescent shaped surface area. It can be used as a body support pillow by a child, or as a nursing pillow for a reclining infant. Another pillow designed for infant support is described in U.S. Pat. No. 5,261,134 to Matthews. U.S. Pat. No. 5,154,649 to Pender offers an inflatable nursing pillow with multiple adjustable air chambers for customized support during nursing. Other prior art patents relating to support pillows include U.S. Pat. No. 5,707,031 to Creighton-Young, U.S. Pat. No. 5,790,999 to Clark, U.S. Pat. No. 5,522,104 to Little, and U.S. Pat. No. 5,581,833 to Zenoff.

Other nursing pillows focus on supporting the arm of the mother, which in turn supports the head and body of one baby, such as U.S. Pat. No. 5,133,098 to Weber. This pillow is wedge-shaped to provide an inclined position for the baby laterally across mother's lap. Other pillows have recessed areas for a nursing infant. U.S. Pat. No. 5,551,109 to Tingley offers a pillow that the mother cradles in her arm that has a generally flat recessed surface area and overlapping straps which hold the infant in place. Also, U.S. Pat. No. 5,092,005 to Byrn provides a depression in the center of the pillow for the baby to lay within.

U.S. Pat. No. 5,334,082 to Barker is an augmenting bust support pillow requiring a brassiere to uplift the breast. It is created to enhance the breast and create cleavage as an alternative to surgical breast implants. The pillow is a crescent shape made from breast implant type gel. These pillow supports do not provide enough lift to the breast to position the nipple for the act of breastfeeding or are dependent upon the brassiere for the minimal lift. The materials used to simulate breast tissue are much more complicated than are needed for the purpose of breastfeeding. The crescent shape would offer no real advantage to the act of breastfeeding since the shape for the bust support pillow is derived from that of the brassiere cup and is dependent upon the cup for the desired support. U.S. Pat. No. 5,603,653 to Hartman discloses perspiration absorbent pads for female breasts adapted for placement between the overlying breast and the adjacent surface of the chest to preclude skin-to-skin contact and to absorb perspiration in that area. The pads provide for moisture absorption and also provide some uplifting of the breast to produce the appearance of a fuller bust line. Again these pads only provide minimal uplift and are not designed to provide sufficient uplifting of the breast and nipple in order to facilitate breastfeeding.

Each of these solutions is impractical in most cases. The existing pillows and breastfeeding aids described above suffer from a number of disadvantages and are very limiting for the mother.

A problem for mothers with large breasts is that cupping and lifting the breast with the free hand at each feeding, which can last anywhere from 15 minutes or more per breast, can be extremely limiting and tiring.

Another problem for mothers with large breasts is that her free hand is not available for any other activity during the feeding limiting interaction with the baby such as stroking the baby's arms or legs.

Another problem for mothers with large breasts, especially for woman with disabling conditions relating to their hands, wrists and arms, is that they may have a very difficult time cupping their breast for an extended amount of time.

Another problem is that existing support aids also require the mother to utilize her hands and arms to keep a baby positioned on a pillow. Her hands are not free to tend to activities like positioning, caressing or tending to the child.

Another problem with existing support aids is that they are large pillows that either wrap around the waist of a breastfeeding woman, lay on her lap or support her body or extremities.

Another problem with existing support aids is that they are designed only to support the position of the baby upon the pillow or the breastfeeding mother's extremities during the act of breastfeeding rather than support of the breast for the act of breastfeeding.

Another problem with existing support aids is that for large breasted women, especially overweight and large breasted women, it is virtually impossible to fit a pillow, baby and breast all within a limited amount of lap space.

Another problem with existing support aids is that, for large breasted women even when using pillows outside of the lap to support the arm or elbow, the breast and nipple are not in a proper position for proper latching.

Another problem with existing support aids is that they are not practical when choosing to breastfeed outside the home because they are very bulky to use or carry.

Another problem with existing support aids is that they are very conspicuous when choosing to breastfeed outside the home. Most women prefer the act of breastfeeding to be inconspicuous in public areas whereas a large pillow would draw attention to the breastfeeding woman.

Another problem with existing support aids is that they limit the mobility of the nursing mother inside and outside the home. For a nursing woman to lay down at each of the recommended 8 to 12 feedings a day severely limits her. In addition, this laying down position prevents adequate interaction and eye contact between the breastfeeding woman and baby.

Another problem with existing support aids is that, although towels or diapers can be rolled into whatever diameter is needed, depending on the material that is used they can be found to be hard and incompressible underneath the breast.

Another problem with existing support aids is that the hardness and incompressibility of the support aids can exert strong pressure on the mammary ducts and sinuses prohibiting breast milk flow, closing the ducts and possibly leading to mastitis.

Another problem with existing support aids is that, when using a rolled up towel or diaper, they are awkward to prepare and use.

Another problem with existing support aids is that a mother has to use both hands to adequately roll the towel or diaper to the proper size which is difficult to do consistently especially with a crying and hungry baby.

Another problem with existing support aids is that the extra material from the towel or diaper ends up interfering with the feeding by distracting the baby, coming between the baby and breast or simply unrolling during the feeding.

Another problem with existing support aids is that a rolled up disposable diaper creates an environment that promotes fungal growth beneath the breast. The plastic liner creates moisture and is not absorbent and this fungal growth or ensuing infection may be passed on to the infant.

SUMMARY OF THE INVENTION

Breastfeeding a baby requires dedication and determination. However, the act of breastfeeding requires extra effort for a mother with large breasts in order to properly position the baby and the breast in relation to each other. The present invention relates to a breastfeeding aid which properly positions the breast and nipple of the large breasted mother in relation to the nursing child's mouth and body to facilitate the act of breastfeeding.

The present invention is a breastfeeding breast support roll. By placing the breastfeeding breast support roll underneath the mother's breast, the breast and nipple are uplifted and the nipple is positioned outward to promote proper breastfeeding position and latching. The breastfeeding breast support roll is compact in size and designed with, but not limited to, squared or rounded edges. The breastfeeding breast support roll is made of one or more outer layers of soft, absorbent washable or disposable material and is filled with compressible, absorbent and or resilient fill.

It is therefore an object of the present invention to provide a breastfeeding breast support roll that promotes successful breastfeeding efforts, especially for large breasted women.

It is a further object of the present invention to provide a device of the character described that supports and uplifts a nursing mother's breast towards the breastfeeding infant.

It is a further object of the present invention to provide a device of the character described that raises the nipple upward and outward for proper positioning in relation to the breastfeeding child's mouth.

It is a further object of the present invention to provide a device of the character described that allows babies to nurse on their sides, facing mother, rather than flat on their backs with their heads turned to the side.

It is a further object of the present invention to provide a device of the character described that prevents improperly positioned nursing babies from having ear infections (because the breastmilk drains to the head rather than to the stomach), reflux problems and digestion disorders.

It is a further object of the present invention to provide a device of the character described that is compact, fitting the baby and breast all within a limited amount of lap space.

It is a further object of the present invention to provide a device of the character described that is practical when choosing to breastfeed outside the home because it is not bulky to use or carry.

It is a further object of the present invention to provide a device of the character described that is not conspicuous when choosing to breastfeed outside the home. Most women prefer the act of breastfeeding to be inconspicuous in public areas.

It is a further object of the present invention to provide a device of the character described that does not limit the mobility of the nursing mother inside and outside the home.

It is a further object of the present invention to provide a device of the character described that does not necessitate a nursing woman to lay down at each of the recommended 8 to 12 feedings a day, severely limiting her mobility.

It is a further object of the present invention to provide a device of the character described that provides adequate interaction and eye contact between the breastfeeding woman and baby.

It is a further object of the present invention to provide a device of the character described that allows a mother to have full use of her free hand to assist with latching-on (positioning baby's mouth to nipple), latch-release (releasing baby's suckle when finished or asleep, caressing and burping.

It is a further object of the present invention to provide a device of the character described that prevents arm, shoulder, neck, and back strain by promoting comfortable, proper positioning of the mother.

It is a further object of the present invention to provide a device of the character described that is adjustable to accommodate the varying size of the breast.

It is a further object of the present invention to provide a device of the character described that comes in several sizes to accommodate varying size of the breast.

It is a further object of the present invention to provide a device of the character described that are particularly adapted for placement between the overlying breast and the adjacent surface of the chest.

It is a further object of the present invention to provide a device of the character described that require no adhesives or other form of retention to remain in place.

It is a further object of the present invention to provide a device of the character described that prevents skin-to-skin contact to absorb perspiration in that area.

It is a further object of the present invention to provide a device of the character described that may be formed of reusable or economically disposable materials, as desired.

It is a further object of the present invention to provide a device of the character described that is not hard and incompressible underneath the breast.

It is a further object of the present invention to provide a device of the character described that does not exert strong pressure on the mammary ducts and sinuses prohibiting breast milk flow, closing the ducts and possibly leading to mastitis.

It is a further object of the present invention to provide a device of the character described that is not awkward to prepare and use.

It is a further object of the present invention to provide a device of the character described that does not interfere with the feeding by distracting the baby, coming between the baby and breast or simply unrolling during the feeding.

It is a further object of the present invention to provide a device of the character described that does not create an environment that promotes fungal growth beneath the breast.

It is a further object of the present invention to provide a device of the character described that is absorbent and prevents fungal growth or infection that may be passed on to the infant.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which:

FIG. 1 is perspective view of a baby cradled in a mother's arms and properly positioned in relation to the breast for feeding;

FIG. 2 is a perspective view of an infant properly latched onto the mother's breast;

DETAILED DESCRIPTION OF THE INVENTION

The present invention is a breastfeeding aid particularly suited for mothers with large breasts. When a mother has large breasts, breastfeeding a baby requires extra effort in order to properly position the baby and the breast in relation to each other. The present invention provides breastfeeding breast support roll which properly positions the breast and nipple of the large breasted mother in relation to the nursing child's mouth and body to facilitate the act of breastfeeding.

Referring to FIGS. 1 and 2: In order to breastfeed properly, it is crucial to have the breastfeeding baby properly positioned in relation to the breast. Proper positioning ensures that the infant achieves a proper "latch-on" with the breast. Positioning and posture of the body, and the position of the baby's body in relationship to the mother's, is of utmost importance. For example, when using a cradle hold as in FIG. 1, the baby's head should rest in the crook of the mother's elbow at height H1, with the forearm supporting his back, and the hand holding the buttocks or upper thigh. The baby is lying on his side with his body facing the mother and his head is in a straight line with his body. In this position, with the baby's head in the crook of the mother's arm at height H1, the baby's mouth is positioned at height H2 parallel with the mother's nipple which is at height H2. This parallel positioning allows the baby to properly latch-on to the mother's nipple, as in FIG. 2.

Figure 6:
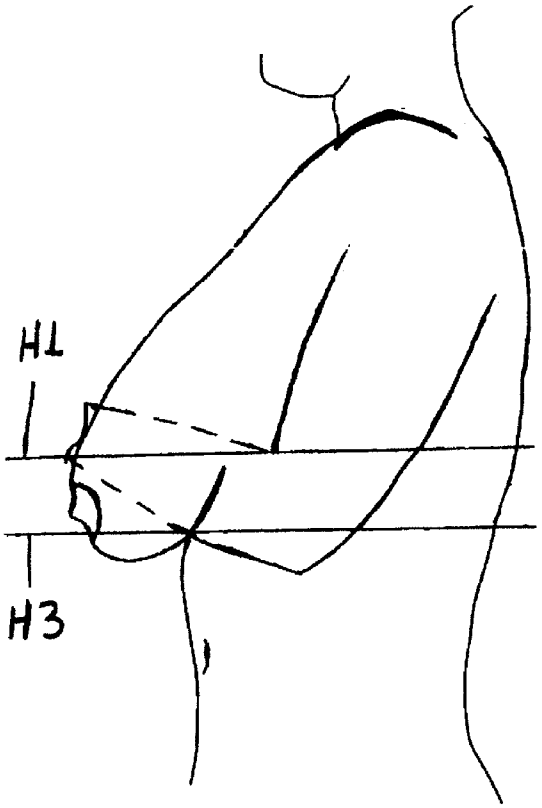
FIG. 6 is an elevation view showing the relation between a woman's large breast and nipple to the crook of the bent elbow where a breastfeeding infant's head would rest.

Referring now to FIG. 6: Large breasted women invariably have a difficult time establishing proper position, and therefore a proper latch, due to the size and shape of the large breast. A large breast has a tendency to sag below the level that the arm can comfortably cradle the baby within the lap space available. Some large breasted mothers also have difficulty placing their babies parallel to their breasts because their breasts almost touch their laps as they sit down. The baby's head is then positioned in the crook of the mother's arm at height H1, and the child's mouth is then improperly positioned at height H2 above the breast and nipple that are at height H3.

Some large breasted women also have large areolas and nipples and the nipple may be positioned pointing downwardly rather than outwardly, which is necessary for proper latching. To release the milk in his mother's breast, the baby needs to compress the lactiferous sinuses (also called milk sinuses or milk reservoirs) located under the areola. Therefore, it is important for the baby to grasp the entire nipple and as much of the areola as his mouth allows. When the nipple and areola point downwardly as in FIG. 6, instead of outwardly as in FIGS. 7 and 8, the baby cannot latch properly and is unable to compress the lactiferous sinuses and release the milk in his mother's breast. The problem can be further exacerbated if the infant is small or born prematurely.

Lactation consultants suggest that these women lift the breast so it is high enough for the baby to latch on to the nipple. One suggestion for supporting the breast is using a rolled up diaper underneath the breast. Another suggestion for supporting the breast is using a soft, stretchy piece of fabric, worn around the neck, and brought under one breast, gently supporting it. Supporting and lifting the breast helps to keep the breast from covering the baby's nose, enabling baby to breathe and swallow properly. Another suggestion is that large breasted women hold their breast throughout the nursing session to keep their breasts off the baby's chin and nose, and to keep the nipple in the baby's mouth. Whatever method is chosen to support the breasts, it is important they are well supported without distorting their shape. As mentioned hereinabove, these actions for supporting the breast suffer from a variety of disadvantages.

Figure 7:
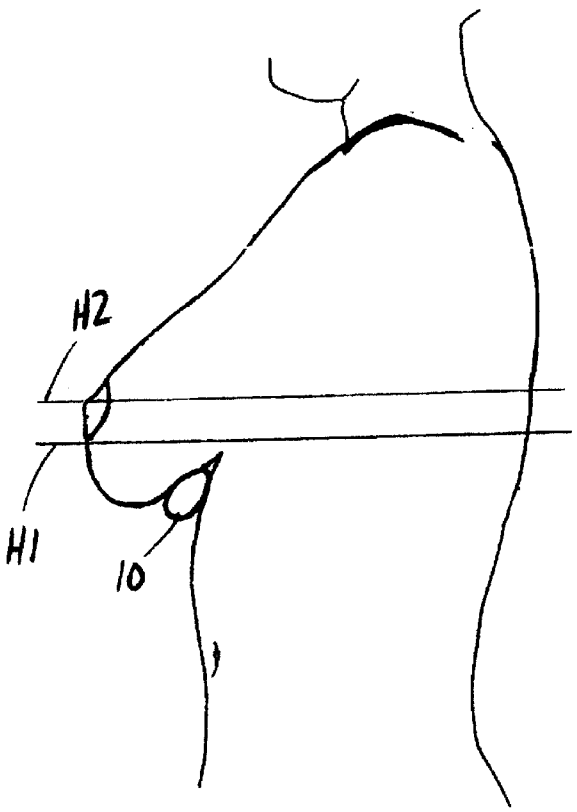
FIG. 7 is an elevation view illustrating the effect of the present invention uplifting the breast and nipple outward and upward in relation to the height of the crook of the bent elbow of FIG. 6.

Referring now to FIGS. 6 and 7: By placing a breastfeeding breast support roll 10 underneath the breast (between the breast and the underlying chest) the support roll 10 raises the nipple from its original unsupported height H3, preferably at least up to the crook of the elbow at height H1, and most preferably to a height H2 above the crook of the elbow. The placement of the breastfeeding breast support roll 10 underneath the mother's breast also uplifts the breast and nipple so that the nipple is positioned outward at height H2, instead of downward as it was when unsupported at height H3, to promote proper breastfeeding position and latching.

Figure 3:
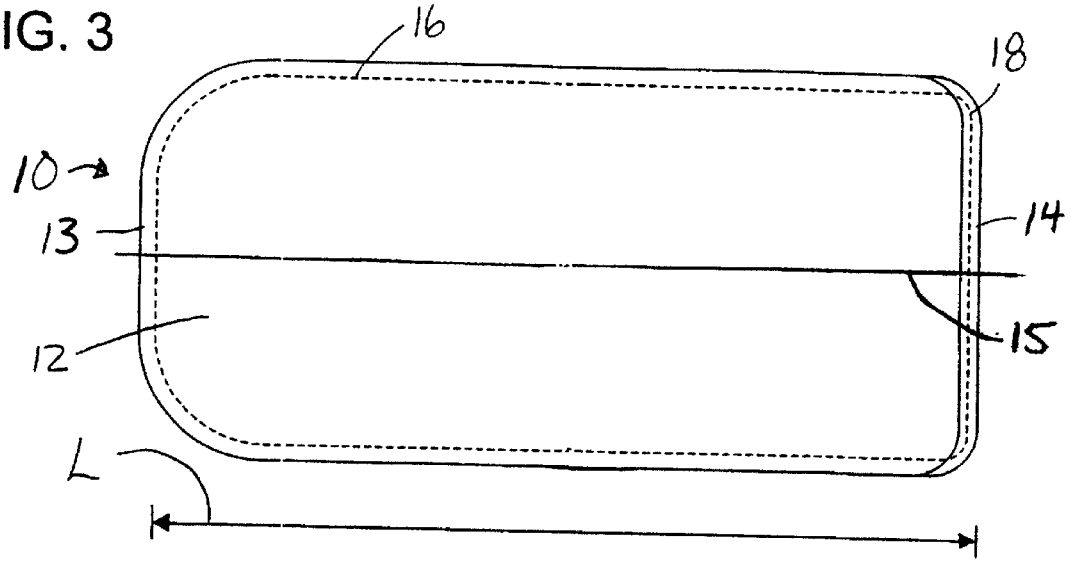
FIG. 3 is a elevation view of the breastfeeding breast support roll constructed in accordance with the present invention.
Figure 4:
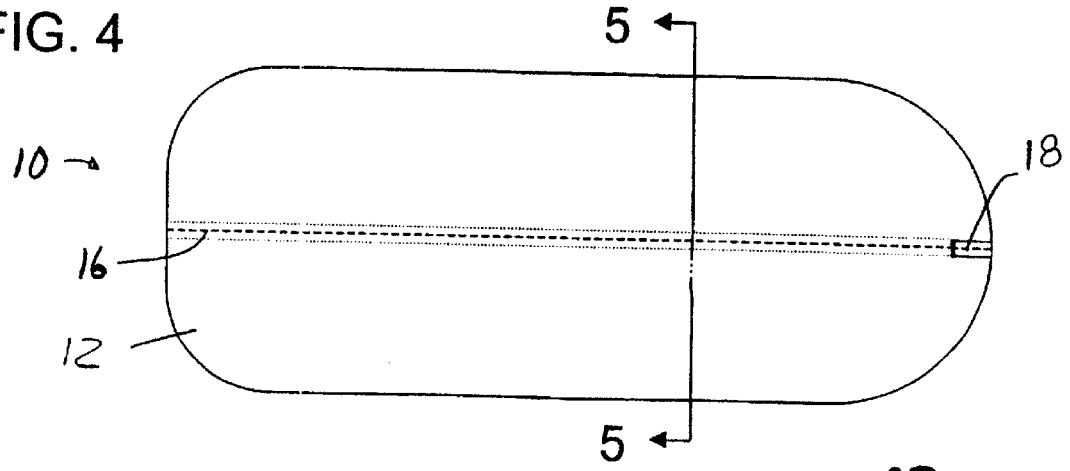
FIG. 4 is a plan view of the breastfeeding breast support roll constructed in accordance with the present invention.
Figure 5:
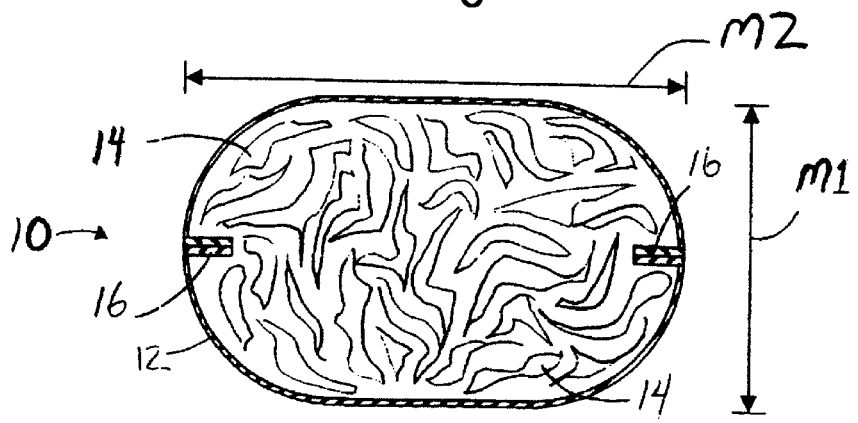
FIG. 5 is an end seam cross-section view along line 5—5 of FIG. 4.

Referring to FIGS. 3 through 5: The breastfeeding breast support roll 10 is advantageously constructed both functionally and structurally to promote successful breastfeeding. The breastfeeding breast support roll 10 is compact in size and therefore portable. The breastfeeding breast support roll 10 is also designed to be lightweight and soft so that it may fit comfortably beneath a breast and may be held in place by the overlying breast. The breastfeeding breast support roll is made of one or more outer layers of soft, absorbent washable or disposable material and is filled with compressible, absorbent and/or resilient fill. The overall shape and texture in which the breastfeeding breast support roll 10 is configured allows it to be self-contouring to the breast.

In the preferred embodiment of the present invention, the breastfeeding breast support roll 10 comprises a generally elliptic cylindrical body with a length L substantially greater than the larger of its cross-sectional axes (the diameter or the major axis M2). More specifically, the generally cylindrical body of the breastfeeding breast support roll 10 has a first end 13 and a second end 14. The length L of the breastfeeding breast support roll 10 may be defined as the measurement parallel to a longitudinal axis 15 running between and perpendicular to the first and second ends 13 and 14. The breastfeeding breast support roll 10 has a generally elliptical cross-section normal to the longitudinal axis 15, perpendicular to the length L measurement.

The shape, i.e., length L and the elliptic cross-section of the breastfeeding breast support roll 10 are suitable to fit completely beneath a mother's breast, between the breast and the chest wall. A typical length L from end to end of a breastfeeding breast support roll 10 is approximately four to eight inches and preferably about six inches in length. A typical diameter or length of the minor or major axes M1 and M2 is approximately two to four inches. Alternatively, the breastfeeding breast support roll 10 may be of longer or shorter length L, or of smaller or larger cross-section as appropriate, according to the size of the mother's breast.

The breastfeeding breast support roll 10 preferably has ends 13 and 14 that are tapered lengthwise along the longitudinal axis 15. Thus, the cross-section at the center of the breastfeeding breast support roll 10 may gradually taper to a smaller cross-section at each of the first and the second ends 13 and 14. This provides greater comfort for the breast which lies atop the breastfeeding breast support roll 10 as well as providing a graduated surface that is simpler for the overlying breast to grip. The breastfeeding breast support roll 10 preferably tapers gradually toward each end 13 and 14, but may taper towards either one or both ends 13 and 14 more abruptly. Alternatively, the breastfeeding breast support roll 10 may have squared, right cylindrical or rounded (capsule shaped) ends 13 and 14.

The length L from end to end is sufficient for the breastfeeding breast support roll 10 to fit completely beneath a breast and supported in place by the breast. The breastfeeding breast support roll 10 should not be too short, extending a majority of the distance beneath the breast from the armpit to the sternum. By extending beneath a majority of the breast, the breastfeeding breast support roll 10 provides sufficient support from beneath the breast to raise the breast and nipple to a proper position for breastfeeding.

The breastfeeding breast support roll 10 also should not be too long. If the ends of the breastfeeding breast support roll 10 extends from underneath the sides of the breast it may interfere with breastfeeding the child or the end may extend beyond the sides of the breast towards the arm or adjacent breast. The feeding baby or the mother's arm may dislodge the breastfeeding breast support roll 10 from underneath the breast. If the breastfeeding breast support roll 10 is fully or partially dislodged from underneath the breast, then the nipple may no longer be parallel to the baby who may not be able to maintain a proper latch on the breast. The latch may then need to be broken in order to reposition the breast, the baby or the breastfeeding breast support roll 10.

Referring now to FIG. 5: The breastfeeding breast support roll 10 is substantially elliptical in cross section (perpendicular to the longitudinal axis 15). The cross sectional area of the breastfeeding breast support roll 10 can be defined by a major axis M2 and a minor axis M1. If the major axis M2 equals the minor axis M1, then a circular cross-section, of the breastfeeding breast support roll 10 is defined. The major axis M2 is preferably no wider than half the length (vertical hang) of the breast. Although the breastfeeding breast support roll 10 depicted in FIG. 5 is of substantially elliptical cross-section, it is also within the scope of the invention to have a cross-section that is ovate (egg-shaped). With an ovate cross-section, one side of the breastfeeding breast support roll 10 tapers from the center of the breastfeeding breast support roll 10 more quickly in one direction along the major axis M2 than in the opposite direction along the major axis M2. Furthermore, one side of the breastfeeding breast support roll 10 may taper from the center of the breastfeeding breast support roll 10 more quickly in one direction along the minor axis M1 than in the opposite direction along the minor axis M1. This overall shape in which the breastfeeding breast support roll 10 is configured allows it to be self-contouring to the overlying breast.

FIG. 5 illustrates an elliptical cross-section of a breastfeeding breast support roll 10 including a soft and absorbent outer layer 12 and fill 24. In the preferred embodiment of the breastfeeding breast support roll 10, the outer layer 12 consists of a soft material such as cotton, cotton/polyester blend, or flannel type material. In another embodiment of the invention, in a disposable breastfeeding breast support roll 10, the soft and absorbent outer layer 12, may consist of disposable and/or biodegradable materials such as crepe-type paper. In another embodiment, the breastfeeding breast support roll 10 may also comprise an outer layer 12 and/or fill 24 with antibacterial or antimicrobial properties. The fill 24 is preferably of lightweight, washable or disposable resilient and or compressible material, including but not limited to random fiber, cotton, polyester, down, or cellulose or a rolled sheet of such materials. One skilled in the art will understand a variety of materials may be substituted for the listed materials to achieve desired properties of washability, permeability, disposability, and absorbability.

Referring again to FIGS. 3 through 5: In a method of construction of a breastfeeding breast support roll 10, the outer layer 12 is sewn about three sides to form an inner seam 16 (drawn in ghost) to form a cavity defined by the length L and minor and major axes M1 and M2 of the breastfeeding breast support roll 10. Fill 14 is placed inside the cavity formed by the outer layer 12 as sewn along the inner seam 16. After the fill 24 is placed within the cavity and the density of the fill 24 provides the desired resiliency and compressibility, the cavity is then sewn shut at end seam 18.

Figure 8:
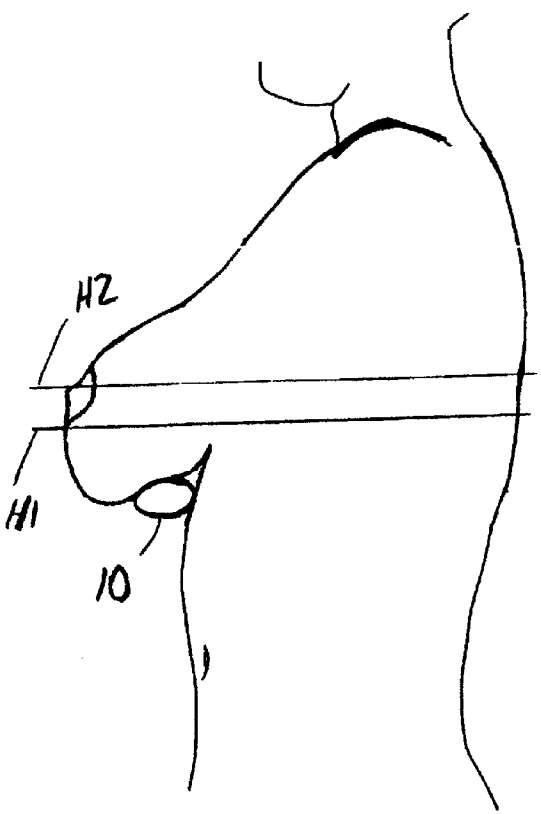
FIG. 8 is an elevation view illustrating the effect of the present invention uplifting a fuller breast and nipple outward and upward in relation to the height of the crook of the bent elbow of FIG. 6.

Referring now to FIGS. 6 through 8: In operation, the breastfeeding breast support roll 10 is placed underneath the breastfeeding breast, which supports the breast and allows a large breasted woman to breastfeed in an upright position without difficulty. Because it can be challenging for the large breasted woman to find a comfortable position in which to nurse, lactation consultants recommend feeding the baby while sitting back in a recliner, on her back, or laying in bed, with the baby at the mother's side supported at breast level. This can be very inconvenient for accomplishing the 8–12 daily feeding and seriously limits a mother's mobility and ability to accomplish other tasks. The breastfeeding breast support roll 10 does not limit a mother's mobility and allows a large breasted woman to breastfeed in an upright position, sitting, standing or even walking, without difficulty, as well as other positions.

The breastfeeding breast support roll 10 is placed underneath the breast, between the breast and chest wall, which allows a large breasted woman to feed a baby with less difficulty. This is achieved because the breastfeeding breast support roll 10 uplifts the breast and nipple from its unsupported position H3 and positions the breast and nipple at least as high as the crook of the bent elbow at position H1, and preferably above the crook of the bent elbow position H2, outward and parallel to a breastfeeding baby. When the breastfeeding breast support roll 10 is placed beneath the breast, it is self-contouring to the breast because of its shape, size, weight and compressibility.

Referring to FIGS. 7 and 8: The breastfeeding breast support roll 10 may have various sizes, with the proper size being no longer in length L than the distance between sides of the breast towards the arm or adjacent breast, and no wider than half the vertical sag of the breast. Furthermore, each breastfeeding breast support roll 10 provides at least two different modes (sizes) in which to provide support to a breast by simply repositioning the support roll 10 with respect to the woman's breast and torso. As shown in FIG. 7, the breastfeeding breast support roll 10 is one size when the major axis M2 is placed substantially parallel to the breastfeeding woman's torso. This lifts the breast a distance substantially equal to the length of the minor axis M1. As shown in FIG. 8, for a woman with a fuller breast, the breastfeeding breast support roll 10 is another size when the minor axis M1 positioned parallel to the breastfeeding woman's torso. This lifts the breast further, a distance substantially equal to the length of the major axis M2. To provide for varying types of support necessary for the breast depending on its fullness, the breastfeeding breast support roll 10 may be placed beneath the breast with either the major M2 or minor M1 axis parallel to the woman's torso or rotated to any position between those depicted in FIGS. 7 and 8. This size versatility is a convenient feature making the breastfeeding breast support roll 10 adaptable to the varying breast size of the mother at different feedings.

The size, weight and shape of the breastfeeding breast support roll 10 make it easy and convenient to use. The compact generally elongated and generally columnar shape of the breastfeeding breast support roll 10 allows for the positioning of the breastfeeding breast support roll 10 under the breast quickly and inconspicuously with one hand. The breastfeeding breast support roll 10 is also convenient to have on hand and is easy to carry and store. Unlike other breastfeeding support aids, it is compact and can be carried inconspicuously in a diaper bag, purse or even a pocket. In addition, the breastfeeding breast support roll 10 is designed so that no extra material comes between or interferes with the act of breastfeeding as do a rolled up diaper or towel. The breastfeeding breast support roll 10 also maintains consistency in shape and size, unlike a rolled up diaper or towel.

The breastfeeding breast support roll 10 is also designed to be gentle underneath the breast allowing the breast to lie naturally and gently on top of it. The breastfeeding breast support roll 10 does not have the noncompressibility and hardness of other support aids, which can exert pressure on the mammary ducts and sinuses, and which can interfere with milk flow and the health of the breast. The breastfeeding breast support roll 10 also prevents the weight of the heavy breast from applying pressure on the baby's mouth, which makes it difficult for the baby to keep the nipple in his mouth. This also prevents the baby from slipping off the milk reservoirs and only compressing his jaws around milk tubing near the nipple that may damage the mother's nipples. By allowing the baby to nurse well feeding are not missed, and the necessity of expressing milk (which may be difficult and may detract from establishing the nursing relationship) is obviated.

Because the breastfeeding breast support roll 10 accomplishes the uplifting of the breast and proper positioning of the nipple when placed underneath the breast, there is no need for the free hand to cup the breast to lift it. This allows for the freedom of the hand not cradling the baby during the feeding to be used to promote interaction of the breastfeeding woman and baby. The freedom of movement also enables the breastfeeding woman to have a free hand to do other tasks such as eating and drinking when breastfeeding. Also, for women with disabling conditions relating to their hands, wrists and arms this freedom of the hand helps to prevent the fatigue and stiffness that is often associated with these conditions and the act of breastfeeding.

The breastfeeding breast support roll 10 can also be used either with a brassier or without one. Because the breastfeeding breast support roll 10 is held in place underneath the breast by the weight, size and shape of the breast, it is not dependent on a brassier for use or support.

It will be appreciated that the foregoing description is illustrative only, and that the breastfeeding breast support roll 10 may be varied in details without departing from the spirit of the invention.

What is claimed as my invention is:

1. A breastfeeding breast support roll for supporting a breast, comprising:

a mass of resilient, compressible fill; and at least one cover layer surrounding said mass of resilient, compressible fill forming a substantially elliptic cylindrical roll;

said elliptic cylindrical roll having a first end, a second end, an end-seam at said second end, a longitudinal axis perpendicular to said first and second ends, and a length between said first and second ends along said longitudinal axis;

said elliptic cylindrical roll having a central first cross-section located between said first and second ends, said central first cross section being a maximum cross-section having a major axis perpendicular to said longitudinal axis and a minor axis perpendicular to said longitudinal axis;

said central first cross-section of said elliptic cylindrical roll tapering to a smaller second cross-section at said first end;

said central first cross-section of said elliptic cylindrical roll tapering to said end-seam at said second end;

wherein said elliptic cylindrical roll has a size and shape adapted for placement, capture and retention between the underside of a breast of a female and an underlying surface of the torso of said female;

and wherein said elliptic cylindrical roll has a size and shape further adapted to uplift said breast from said torso, thereby uplifting a nipple of said breast to a raised position normal to said torso;

said raised position of said nipple being at least as high as an elbow of said female adjacent said breast.

2. The breastfeeding breast support roll of claim 1, wherein said length between said first and second ends along said longitudinal axis is not longer than a first distance along said underside of said breast, said first distance being between a sternum and an armpit of said female.

3. The breastfeeding breast support roll of claim 2, wherein said major axis is not longer than half a second distance along said underside of said breast, said second distance being between a nipple and a junction of said underside of said breast and said torso of said female.

4. The breastfeeding breast support roll of claim 3, wherein said cover layer comprises soft and absorbent outer layer of woven material selected from the group comprising, cotton, cotton/polyester blend, and flannel.

5. The breastfeeding breast support roll of claim 4, wherein mass of fill comprises a lightweight, resilient or compressible material selected from the group consisting of random fiber, cotton, polyester, down, and cellulose.

6. The breastfeeding breast support roll of claim 5, wherein said cover layer and said fill comprise disposable and biodegradable materials.

7. The breastfeeding breast support roll of claim 6, wherein said cover layer and said fill comprise materials with antibacterial or antimicrobial properties.

8. A method of breastfeeding a child from a breast, comprising the steps of:

lifting a female breast a distance sufficient to expose a female breast underside and a female torso underlying said breast;

placing an elliptic cylindrical roll between said female breast underside and said female torso underlying said breast;

said elliptic cylindrical roll comprising a cover layer surrounding a mass of resilient compressible fill;

said elliptic cylindrical roll having a first end, a second end, an end-seam at said second end, a longitudinal axis perpendicular to said first and second ends, and a length between said first and second ends along said longitudinal axis;

said elliptic cylindrical roll having a central first cross-section located between said first and second ends, said central first cross section being a maximum cross-section having a major axis perpendicular to said longitudinal axis and a minor axis perpendicular to said longitudinal axis;

said central first cross-section of said elliptic cylindrical roll tapering to a smaller second cross-section at said first end;

said central first cross-section of said elliptic cylindrical roll tapering to said end-seam at said second end;

lowering said breast to cover said elliptic cylindrical roll, thereby capturing and retaining said elliptic cylindrical roll between said breast underside and said torso;

wherein said elliptic cylindrical roll raises said breast and a nipple and an areola of said breast a vertical distance above an unsupported breast height; and placing said raised nipple and areola in a child's mouth for breastfeeding.

9. The method of breastfeeding of claim 8, further comprising the step of:

orienting said major axis of said elliptic cylindrical roll substantially parallel to said torso before said step of lowering said breast;

and wherein said distance above an unsupported breast height is substantially equal to said minor axis of said elliptic cylindrical roll.

10. The method of breastfeeding of claim 8, further comprising the step of:

orienting said minor axis of said elliptic cylindrical roll substantially parallel to said torso before said step of lowering said breast;

and wherein said distance above an unsupported breast height is substantially equal to said major axis of said elliptic cylindrical roll.

* * * * *